US006269520B1

(12) United States Patent
Kovalchek

(10) Patent No.: US 6,269,520 B1
(45) Date of Patent: Aug. 7, 2001

(54) HINGED BRACKET TO GUIDE AND RESTRICT MOVEMENTS OF OBJECTS THAT ARE NORMALLY VERTICALLY SUPPORTED

(76) Inventor: George Kovalchek, 65 Tadmuck Rd., Westford, MA (US) 01886

( * ) Notice: Subject to any disclaimer, the term of this patent is extended or adjusted under 35 U.S.C. 154(b) by 0 days.

(21) Appl. No.: 09/397,781

(22) Filed: Sep. 16, 1999

(51) Int. Cl.[7] ..... E05D 5/02; E05D 5/10

(52) U.S. Cl. ..... 16/221; 16/387; 16/386; 16/DIG. 29; 16/390; 16/DIG. 43

(58) Field of Search ..... 16/221, 252, 387, 16/389, 390, 391, 392, DIG. 29; 5/660, 617, 610; 312/319.2; 248/291.1; 24/460, 517; 403/119, 161, 363

(56) References Cited

U.S. PATENT DOCUMENTS 1,102,682 * 7/1914 Ping ..... 16/360
4,353,146 * 10/1982 Brockhaus ..... 16/387
4,485,544 * 12/1984 Van Ryswyk ..... 16/386
4,620,610 * 11/1986 Southard ..... 248/291.1
4,669,575 * 6/1987 Skyba ..... 248/291.1
5,042,779 * 8/1991 Eden ..... 254/424
5,181,685 * 1/1993 Ostapowicz ..... 248/291.1
5,243,726 * 9/1993 Bisbee ..... 5/610

* cited by examiner

*Primary Examiner*—Chuck Y. Mah

(57) ABSTRACT

A hinged bracket assembly comprising two elongated brackets one of which is placed inside the other with the same orientation and the two brackets being pivotally attached together on one end of the assembly. A table having a plurality of benches attached thereto comprises a plurality of the hinged bracket assemblies attached to the frame of the table and each of the benches is attached to one of the bracket assemblies to enable each bench to be rotated close to the table or away from the table in order to provide wheelchair access.

4 Claims, 2 Drawing Sheets

HINGED BRACKET TO GUIDE AND RESTRICT MOVEMENTS OF OBJECTS THAT ARE NORMALLY VERTICALLY SUPPORTED

CROSS-REFERENCE TO RELATED APPLICATIONS

Not Applicable.

BACKGROUND

1. Field of Invention

This invention relates to hinges that are used in applications where supporting weight is not the primary concern and in particular to hinged brackets attached to a table with benches for swinging the benches away from the table.

2. Description of Prior Art

Hinges generally provide support for the weight of objects during the entire movement range of the object with relation to where the hinge is affixed. When the design restrictions inherent in providing the ability to support weight are removed, and a means of securing the movable object in a preferred position is attained, a new flexibility can be provided to an overall system especially where other objects of the greater, overall system may be degraded.

SUMMARY OF THE INVENTION

The present invention becomes a modified, slot and groove replacement that is hinged. In this way, the invention allows the members to swing apart from one another around a fulcrum provided by the invention. The invention forms an outer U-shaped bracket which can be put within the groove thereby becoming a groove of substantially the same width less twice the width of the material used to make the bracket. The outer bracket, is formed as an extended "U" shape where the opening size has a characteristic outer bracket opening width. Also, an inner bracket is substantially the same as the outer bracket but with its opening width the same as the opening width of the outer bracket less twice the width of the building material of the inner bracket. The inner bracket is inserted within the outer bracket in the same orientation as the outer bracket and fastened at one end by a simple hinge typically formed with a sex bolt and corresponding holes in the two brackets. Both the inner and the outer brackets become integral halves of the newly formed hinge.

DESCRIPTION OF THE DRAWINGS

In the drawings, closely related figures have the same number but different alphabetic suffixes.

DESCRIPTION OF THE PREFERRED EMBODIMENT

Figure 1:
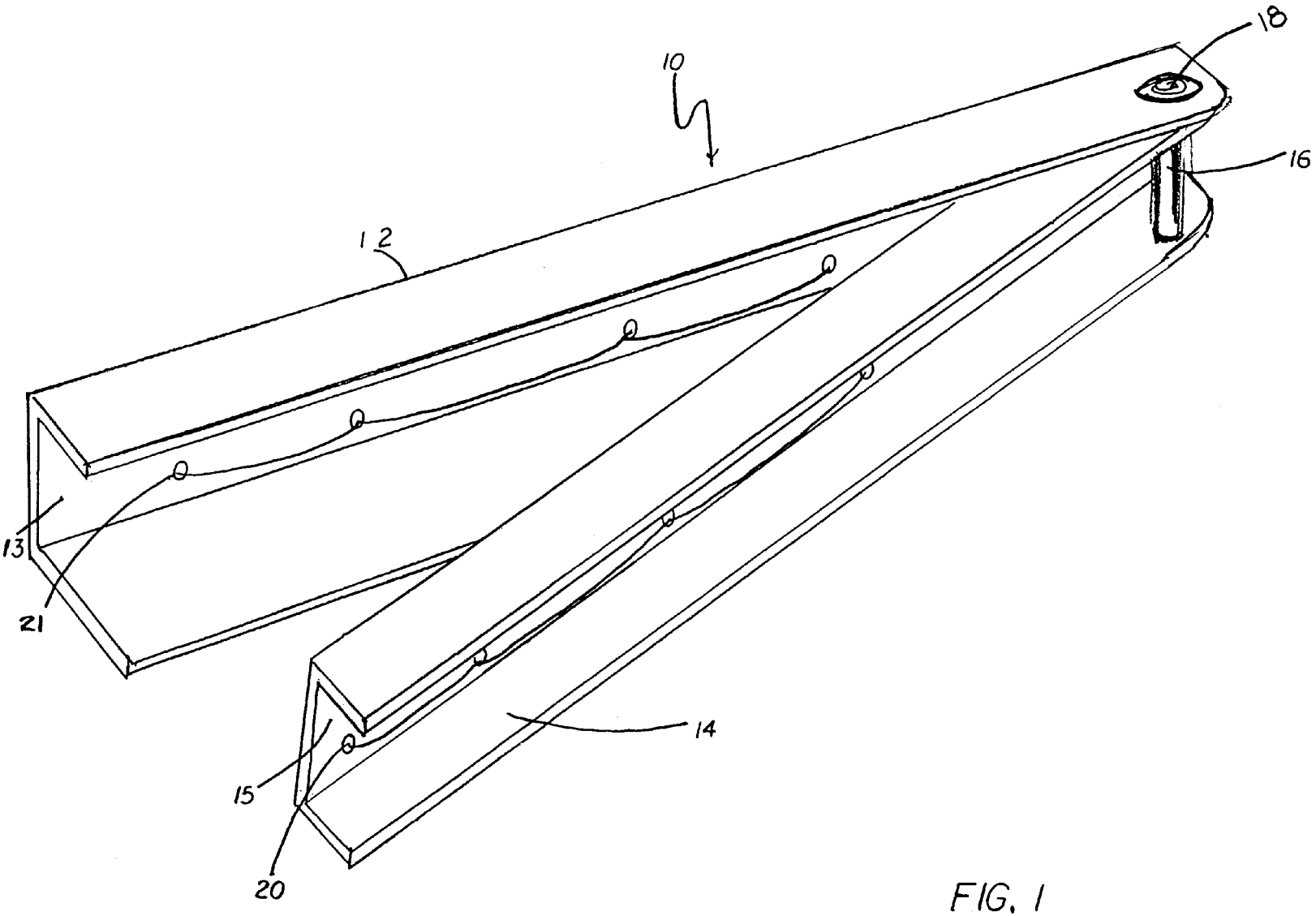
FIG. 1 shows a perspective view of a HINGED BRACKET TO GUIDE AND RESTRICT MOVEMENTS OF OBJECTS THAT ARE NORMALLY VERTICALLY SUPPORTED.

Referring to FIG. 1, a perspective view of a preferred embodiment of the present invention of a hinged bracket assembly 10 to guide and restrict movements of objects is illustrated. The hinged bracket assembly 10 comprises an outer elongated bracket element 12 and an inner elongated bracket element 14 joined together at one end by a cylindrical rod 16 inserted in a first end portion of the bracket assembly 10 and having a sex bolt (not shown) inserted through an opposite first end portion of the assembly 10 whereby the sex bolt inserts into an open end of the cylindrical rod 16.

Figure 2B:
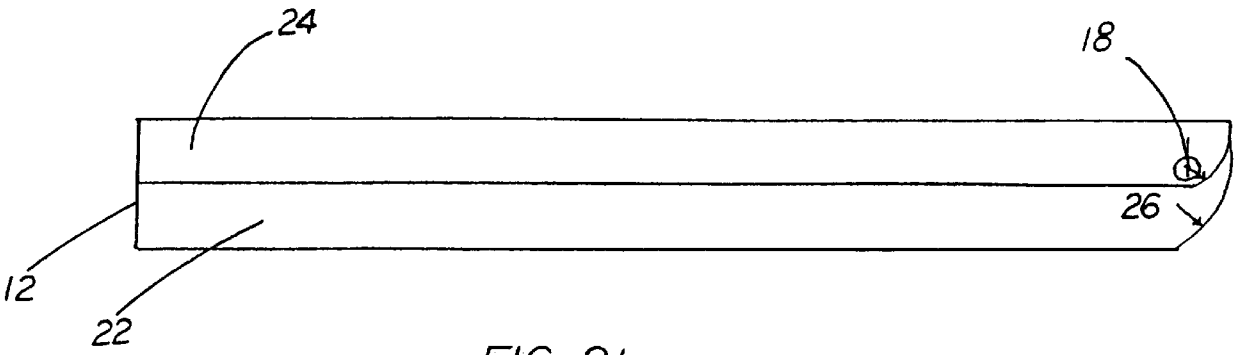
FIG. 2*b* shows an isometric view of the outer bracket element.
Figure 2A:
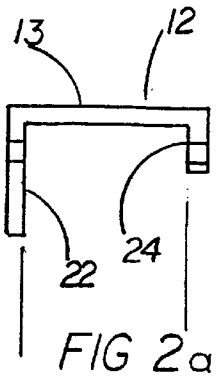
FIG. 2*a* shows a side view of the outer bracket element.

Referring now to FIG. 2*a* and FIG. 2*b*, FIG. 2*a* shows a side view of the outer elongated bracket element 12, and FIG. 2*b* shows an isometric view of the outer elongated bracket element 12. FIG. 2*b* shows a first member 22 that extends beyond a second member 24 of the outer bracket element 12. Member 22 and member 24 are parallel to each other extending perpendicularly from opposite sides of center portion 13. The right side of member 22 has a radius 26 which provides for the clearing the structure to which the hinged bracket assembly 10 is attached.

Figure 3B:
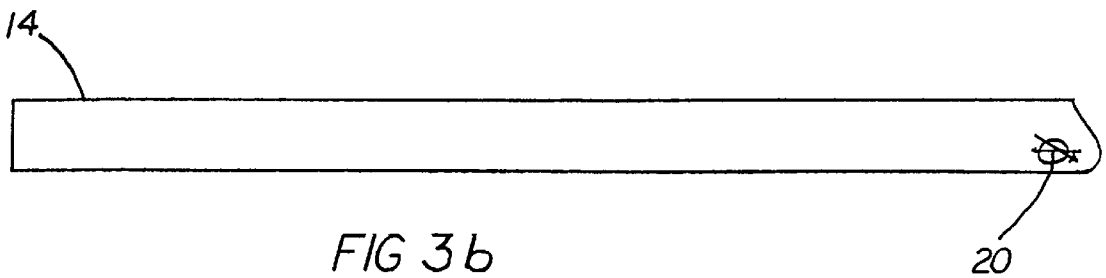
FIG. 3*b* shows a front elevational isometric view of the inner bracket element.
Figure 3A:
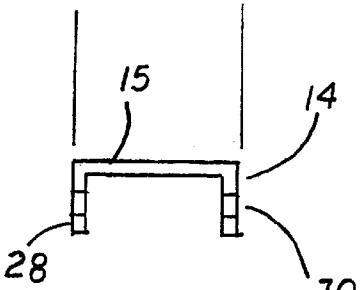
FIG. 3*a* shows a side view of the inner bracket element.

Referring to FIG. 3*a* and FIG. 3*b*, FIG. 3*a* shows a side view of the inner bracket element 14, and FIG. 3*b* shows a front elevational view of the inner bracket element 14. The inner bracket element 14 comprises two members 28 and 30 which are parallel to each other extending at a 90 degree angle from opposite sides of the center portion 15. The far right side of the hinged bracket assembly 10 comprises a cylindrical rod 16 and sex bolt (not shown) which inserts into the end of the cylindrical rod 16. The right ends of members 28, 30 as shown in FIG. 1 are rounded. with the center portion 15 of the inner bracket element 14 being terminated at the cylindrical rod 16. The inner bracket element 14 and the outer bracket element 12 rotate around the combination of the cylindrical rod 16 and the sex bolt.

In the operation of the invention the hinged bracket elements 12, 14 swing apart from one another around a fulcrum such as cylindrical rod 16. The outer bracket element 12 is formed as an extended "U" shape where the opening size has a characteristic outer bracket element 12 opening width. The inner bracket element 14 is substantially the same as the outer bracket element 12, but with its opening width the same as the opening width of the outer bracket element 12 less twice the width of the building material of the inner bracket element 14. The inner bracket element 14 is inserted within the outer bracket element 12 in the same orientation as the outer bracket element 12 and fastened at one end by the hinge formed by the cylindrical rod 16 with the sex bolt inserted therein. Holes in the two bracket elements 12, 14 are provided for receiving the cylindrical rod 16 and sex bolt. Both the inner and the outer bracket elements 12, 14 become integral halves of the newly formed hinged bracket assembly 10.

I claim:

1. A hinge bracket assembly comprising:

a first elongated element having a first center wall and two opposing sidewalls extending perpendicularly from said first center wall, a first of said opposing sidewalls extending a first predetermined distance and a second of said opposing sidewalls extending a second predetermined distance;

a second elongated element having a second center wall and two opposing sidewalls extending perpendicularly from said second center wall, said second elongated element being sized to fit within said first elongated element such that said first and second elements having the same orientation;

means for pivotally attaching a first end of said first elongated element to a first end of said second elongated element, and wherein said pivotally attaching means comprises a cylindrical rod having an open end and being inserted into apertures formed on the opposing sidewalls of the first end of said first elongated element and on the opposing sidewalls of the first end of said second elongated element, a sex bolt being inserted into said open end of the cylindrical rod.

2. The hinge bracket assembly as recited in claim 1 wherein the predetermined distance of said second opposing sidewall of said first elongated element is greater than the predetermined distance of said first opposing sidewall of said first elongated element.

3. The hinge bracket assembly as recited in claim 2 wherein a first end of said second of said opposing sidewalls of said first elongated member curves toward said first center wall.

4. The hinge bracket assembly as recited in claim 1 wherein said first and second elongated elements further comprising a plurality of mounting holes.

* * * * *